US010197343B2

(12) United States Patent
Negi et al.

(10) Patent No.: US 10,197,343 B2
(45) Date of Patent: Feb. 5, 2019

(54) TURBULENCE GENERATOR

(71) Applicant: Rinnai Corporation, Nagoya-shi, Aichi (JP)

(72) Inventors: Hidenao Negi, Nagoya (JP); Toshimitsu Nagasaka, Nagoya (JP); Takaaki Nakagoshi, Nagoya (JP)

(73) Assignee: Rinnai Corporation, Aichi (JP)

( * ) Notice: Subject to any disclaimer, the term of this patent is extended or adjusted under 35 U.S.C. 154(b) by 33 days.

(21) Appl. No.: 15/479,345

(22) Filed: Apr. 5, 2017

(65) Prior Publication Data

US 2017/0307309 A1 Oct. 26, 2017

(30) Foreign Application Priority Data

Apr. 21, 2016 (JP) ..... 2016-84954

(51) Int. Cl.
*F28F 1/40* (2006.01)
*F28F 13/12* (2006.01)

(52) U.S. Cl.
CPC ..... *F28F 13/12* (2013.01); *F28F 1/40* (2013.01)

(58) Field of Classification Search
CPC .... F28F 13/12; F28F 1/40; F28F 13/02; F28F 13/06; F28F 3/027; F28F 1/128; F28F 13/125; F28F 1/10
USPC ..... 165/181; 138/38
See application file for complete search history.

(56) References Cited

U.S. PATENT DOCUMENTS

| | | | | |
|---|---|---|---|---|
| 5,901,641 | A | 5/1999 | McNamara | |
| 6,273,183 | B1 * | 8/2001 | So | F28D 1/0333 165/109.1 |
| 2006/0016582 | A1 * | 1/2006 | Hashimoto | F28D 7/1684 165/109.1 |
| 2006/0243429 | A1 * | 11/2006 | Chu | F28D 1/0316 165/109.1 |

FOREIGN PATENT DOCUMENTS

| | | |
|---|---|---|
| JP | 11-51491 | 2/1999 |
| JP | 11-83196 | 3/1999 |
| JP | 11-108458 | 4/1999 |

* cited by examiner

*Primary Examiner* — David Teitelbaum
*Assistant Examiner* — Harry Arant
(74) *Attorney, Agent, or Firm* — Amin, Turocy & Watson LLP

(57) ABSTRACT

A turbulence generator includes a flat plate member (1) having a plurality of through holes (10*a*), (10*b*), and pairs of projecting pieces (11, 12) and (13, 14) projecting respectively from upstream-side edges and downstream-side edges of the through holes (10*a*), (10*b*), wherein the pairs of projecting pieces (11, 12) and (13, 14) project alternately to front and back surface sides of the flat plate member (1).

4 Claims, 5 Drawing Sheets

PRIOR ART

TURBULENCE GENERATOR

CROSS REFERENCE TO RELATED APPLICATIONS

The present application claims a priority based on a Japanese Patent Application No. 2016-84954 filed on Apr. 21, 2016, the content of which is hereby incorporated by reference in its entirely.

FIELD OF THE INVENTION

The present invention relates to a turbulence generator configured to generate turbulence in a fluid flowing inside the heat-transfer tube accommodated in a heat exchanger.

BACKGROUND ART

A heat-transfer tube accommodated in a heat exchanger is heated by combustion exhaust gas of a gas burner, whereby a temperature of a fluid flowing inside the heat-transfer tube is raised. There has been known an insertion of a turbulence generator configured to generate turbulence in the fluid into the heat-transfer tube in order to suppress local boiling of the fluid inside the heat-transfer tube or promote heat exchange and increase heat efficiency. (For example, Japanese Unexamined Patent Publications No. 2000-266488 A, No. H11-108458 A, No. H11-51491 A and No. H11-83196 A)

For example, as shown in FIG. 5, there has been known a turbulence generator having a plurality of cut-and-raised pieces 31*a*, 31*b*, 31*c* projecting to both front and back surface sides, by applying cut-and-raising-and-bending work to a flat plate member 3. When the fluid flowing inside the heat-transfer tube collides with the cut-and-raised pieces 31*a*, 31*b*, the fluid flows to a tube wall side of the heat-transfer tube, as indicated by solid arrow in FIG. 5. Subsequently, after colliding with the tube wall, the fluid collides with the next cut-and-raised piece 31*c*. The fluid repeats the above-described flow inside the heat-transfer tube. In accordance with this flow of the fluid, the turbulence of the fluid is promoted, so that the local boiling is efficiently suppressed. Further, in order to reduce pressure loss of the fluid by the cut-and-raised pieces 31*a*, 31*b*, 31*c*, all the cut-and-raised pieces 31*a*, 31*b*, 31*c* of the turbulence generator are inclined in a same direction (a downstream direction) so as not to hinder the flow of the fluid.

However, as described above, when all the cut-and-raised pieces 31*a*, 31*b*, 31*c* are inclined in the same direction, the turbulence generator needs to be inserted into the heat-transfer tube in a specific direction in such a manner that inclination directions of the cut-and-raised pieces 31*a*, 31*b*, 31*c* is consistent with a flow passage direction of the fluid flowing inside the heat-transfer tube, and thus, assemble workability is bad. That is, if the turbulence generator is inserted into the heat-transfer tube in a wrong direction where the flow passage direction of the fluid inside the heat-transfer tube and the inclination directions of the cut-and-raised pieces 31*a*, 31*b*, 31*c* are opposed to each other, the pressure loss with respect to the fluid significantly increases. Further, as indicated by two-dot chain arrow in FIG. 5, after the fluid collides with the cut-and-raised piece 31*c* projecting to the front surface side of the flat plate member 3, the fluid passes through a cut-and-raised hole 30*c*. Subsequently, after the fluid collides with the next cut-and-raised piece 31*b* projecting to the back surface side of the flat plate member 3, the fluid passes through a next cut-and-raised hole 30*b*. In this manner, if the turbulence generator is inserted into the heat-transfer tube in the wrong direction, the fluid flows in the vicinity of the front and back surfaces of the flat plate member 3. As a result, the fluid gathers to a vertically central portion inside the heat-transfer tube, so that it hardly flows to the tube wall side of the heat-transfer tube. Therefore, the turbulence is not efficiently generated on the tube wall side, and the local boiling occurs or the heat efficiency of the heat exchanger deteriorates.

SUMMARY OF THE INVENTION

The present invention is to solve the problems of a conventional turbulence generator configured to be inserted into a heat-transfer tube, and an object of the present invention is to provide a turbulence generator capable of bringing about a high turbulence effect without increasing pressure loss of a fluid regardless of a flow passage direction of the fluid flowing inside a heat-transfer tube.

According to the present invention, there is provided a turbulence generator configured to generate turbulence in a fluid flowing inside a heat-transfer tube, comprising, a flat plate member extending along a flow passage direction of the fluid flowing inside the heat-transfer tube when inserted into the heat-transfer tube, wherein the flat plate member has a plurality of through holes formed at predetermined intervals in the flow passage direction, and a pair of projecting pieces extending respectively from an upstream-side edge and a downstream-side edge of each of the through holes, wherein the pair of projecting pieces is disposed in parallel inside each of the through holes, and is inclined so that forefront portions thereof approach each other, the pair of projecting pieces extending respectively from the upstream-side edge and the downstream-side edge of any one of the through holes among the plurality of through holes projects to one surface side of the flat plate member, and the pair of projecting pieces extending respectively from the upstream-side edge and the downstream-side edge of other through hole adjacent to the one through hole projects to other surface side of the flat plate member.

Other objects, features and advantages of the present invention will become more fully understood from the detailed description given hereinbelow and the accompanying drawings which are given by way of illustration only, and thus are not to be considered as limiting the present invention.

PREFERRED MODE FOR CARRYING OUT THE INVENTION

Hereinafter, referring to drawings, a turbulence generator according to an embodiment of the present invention will be described in detail.

Figure 1:
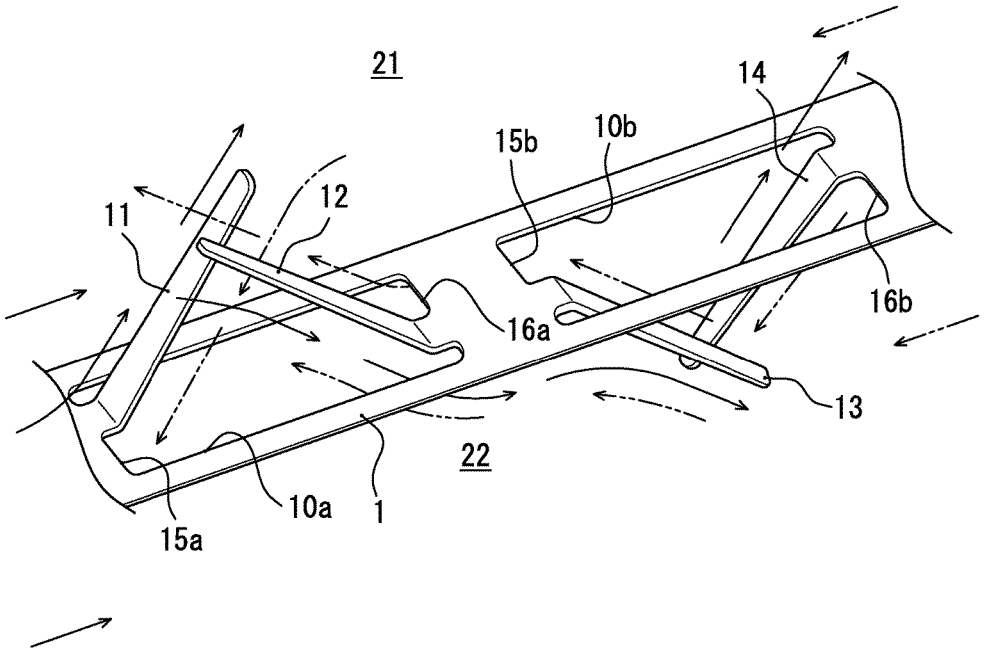
FIG. 1 is a partial schematic enlarged perspective view showing a turbulence generator according to a first embodiment of the present invention.
Figure 2:
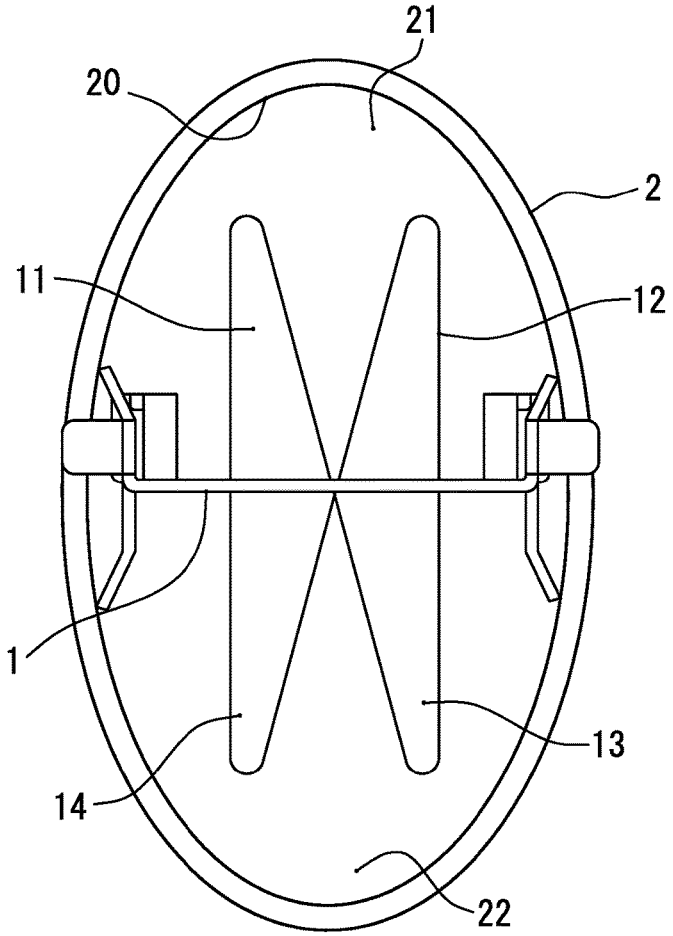
FIG. 2 is a schematic explanatory view showing a state where the turbulence generator according to the first embodiment of the present invention is inserted into a heat-transfer tube.

FIG. 1 is a partial schematic enlarged perspective view showing a turbulence generator according to a first embodiment of the present invention and FIG. 2 is a schematic explanatory view showing a state where the turbulence generator is arranged in a heat-transfer tube.

A turbulence generator shown in FIG. 1 is, for example, inserted into a straight heat-transfer tube 2 having an elliptical cross-sectional shape shown in FIG. 2. The turbulence generator made of a metal includes a long and flat plate member 1 having a width allowing the turbulence generator to be set along a center line of a long diameter of the ellipse of the heat-transfer tube 2, and a length substantially equal to a length of the straight heat-transfer tube 2. By applying cut-and-raising-and-bending work to the flat plate member 1 at many portions along a longitudinal direction, a plurality of substantially rectangular through holes 10*a*, 10*b* as cut-and-raised holes, and a plurality of projecting pieces 11 to 14 as cut-and-raised pieces projecting to front and back surface sides of the flat plane member 1 are formed .

In manufacturing of the turbulence generator, for example, the flat plate member 1 is cut out to form the projecting pieces 11, 12 so that the pair of projecting pieces 11, 12 having a length substantially equal to a length of a long side of the through hole 10*a* is disposed in parallel to each other in a flow passage direction and projects from an upstream-side edge 15*a* and a downstream-side edge 16*a* of the through hole 10*a*, respectively. The pair of projecting pieces 11, 12 is bent at a predetermined degree (for example, about 45 degrees) from vicinities of base end portions thereof toward the front surface side of the flat plate member 1. In this manner, the pair of projecting pieces 11, 12 projects to the front surface side of the flat plate member 1 so that forefront portions thereof cross on the front surface side of the flat plate member 1.

Similarly, the pair of projecting pieces 13, 14 is formed so as to project from an upstream-side edge 15*b* and a downstream-side edge 16*b* of the through hole 10*b* adjacent to the through hole 10*a*, respectively. Further, vicinities of base end portions of the pair of projecting pieces 13, 14 are bent toward the back surface side of the flat plate member 1. In this manner, the pair of projecting pieces 13, 14 projects to the back surface side of the flat plate member 1 so that forefront portions thereof cross on the back surface side of the flat plate member 1.

As described above, the pair of projecting pieces 11, 12 projecting respectively from the upstream-side edge 15*a* and the downstream-side edge 16*a* of the through hole 10*a* to the front surface side of the flat plate member 1 is inclined so that the forefront portions thereof cross each other. Further, the pair of projecting pieces 13, 14 projecting respectively from the upstream-side edge 15*b* and the downstream-side edge 16*b* of the through hole 10*b* adjacent to the through hole 10*a* to the back surface side of the flat plate member 1 is inclined so that the forefront portions thereof cross each other. Accordingly, the plural pairs of projecting pieces 11, 12 and 13, 14 with the forefront portions crossing each other project alternately to the front and back surface sides of the flat plate member 1 at predetermined intervals.

Moreover, the projecting piece 12 projecting from the downstream-side edge 16*a* of the through hole 10*a* on an upstream side to the front surface side of the flat plate member 1, and the projecting piece 13 projecting from the upstream-side edge 15*b* of the adjacent through hole 10*b* downstream of the through hole 10*a* to the back surface side of the flat plate member 1 are provided so as to be located on a same line on the right inside the heat-transfer tube 2 when viewed from the upstream side of the flow passage direction, in the case where the fluid flows from a left side to a right side in FIG. 1.

Furthermore, as shown in FIG. 2, the turbulence generator is inserted into the heat-transfer tube 2 so that a center in a width direction of the flat plate member 1 matches the center line of the long diameter of the heat-transfer tube 2 having the elliptical cross-sectional shape, and thereby, an internal space of the heat-transfer tube 2 is substantially equally partitioned into an upper region 21 on the front surface side of the flat plate member 1 and a lower region 22 on the back surface side of the flat plate member 1. Accordingly, the projecting pieces 11, 12 project to an upper region 21 side and the projecting pieces 13, 14 project to a lower region 22 side.

According to the turbulence generator of this embodiment, as indicated by solid arrow in FIG. 1, in the case where the fluid flows from the left side to the right side, part of the fluid flowing in the upper region 21 of the heat-transfer tube 2 flows to a tube wall 20 on the upper region 21 side of the heat-transfer tube 2 along a front surface of the projecting piece 11 projecting from the upstream-side edge 15*a* of the through hole 10*a* on the upstream side. Further, other part of the fluid flowing in the upper region 21 of the heat-transfer tube 2 passes through the through hole 10*a* along a back surface of the projecting piece 12 on the downstream side, and flows to the lower region 22 of the heat-transfer tube 2. Then, the fluid flowing toward the lower region 22 of the heat-transfer tube 2 flows to the tube wall 20 on the lower region 22 side of the heat-transfer tube 2 together with the fluid flowing in the lower region 22 of the heat-transfer tube 2 along a back surface of the projecting piece 13 projecting from the upstream-side edge 15*b* of the adjacent through hole 10*b* and being located on the same line as the projecting piece 12 on the right when viewed from the upstream side of the flow passage direction.

Moreover, part of the fluid flowing in the lower region 22 of the heat-transfer tube 2 flows to the tube wall 20 on the lower region 22 side of the heat-transfer tube 2 along the back surface of the projecting piece 13, as described above. Furthermore, other part of the fluid flowing in the lower region 22 of the heat-transfer tube 2 passes through the through hole 10*b* along a front surface of the projecting piece 14, and flows to the upper region 21 of the heat-transfer tube 2. Then, although not shown, the fluid flowing toward the upper region 21 of the heat transfer tube 2 flows to the tube wall 20 on the upper region 21 side of the heat-transfer tube 2 along a front surface of a next projecting piece projecting from an upstream-side edge of a next through hole adjacent on the downstream side and being located on the same line as the projecting piece 14 on the left when viewed from the upstream side of the flow passage direction.

On the other hand, as indicated by two-dot chain arrow in FIG. 1, in the case where the fluid flows from the right side to the left side, part of the fluid flowing in the upper region 21 of the heat-transfer tube 2 flows to the tube wall 20 on the upper region 21 side of the heat-transfer tube 2 along a front surface of the projecting piece 12. Further, other part of the fluid flowing in the upper region 21 of the heat-transfer tube 2 passes through the through hole 10*a* along a back surface of the projecting piece 11, and flows to the lower region 22 of the heat-transfer tube 2. Then, although not shown, the fluid flowing toward the lower region 22 of the heat-transfer tube 2 flows to the tube wall 20 on the lower region 22 side of the heat-transfer tube 2 together with the fluid flowing in the lower region 22 of the heat-transfer tube 2 along a back surface of a next projecting piece projecting from an upstream-side edge of a next through hole adjacent on a downstream side and being located on the same line as the projecting piece 11 on the right when viewed from an upstream side of a flow passage direction.

Moreover, part of the fluid flowing in the lower region 22 of the heat-transfer tube 2 flows to the tube wall 20 on the lower region 22 side of the heat-transfer tube 2 along a back surface of the projecting piece 14. Furthermore, other part of the fluid flowing in the lower region 22 of the heat-transfer tube 2 passes through the through hole 10*b* along a front surface of the projecting piece 13, and flows to the upper region 21 of the heat-transfer tube 2. Then, the fluid flowing toward the upper region 21 of the heat transfer tube 2 flows to the tube wall 20 on the upper region 21 side of the heat-transfer tube 2 along a front surface of the projecting piece 12 being located on the same line as the projecting piece 13 on the left when viewed from the upstream side of the flow passage direction.

In this manner, since the fluid flows along the projecting pieces located on the same line on the left or on the right in the flow passage direction through a connecting portion of the flat plate member 2 between the adjacent through holes 10*a*, 10*b*, the fluid can be smoothly guided to the tube wall 20.

In the turbulence generator according to the first embodiment of the present invention, since the pairs of projecting pieces 11, 12 and 13, 14 projecting from the upstream-side edges 15*a*, 15*b* and the downstream-side edges 16*a*, 16*b* of the respective through holes 10*a*, 10*b* are each provided in a V shape, and the pairs of projecting pieces 11, 12 and 13, 14 are formed alternately on the front and back surface sides of the flat plate member 1, number of flow changes by colliding the fluid with the projecting pieces 11,12, 13, 14 is increased, whereby the turbulence of the fluid can be promoted. Accordingly, heat efficiency of the heat exchanger increases.

Further, since the pair of projecting pieces 13, 14 projects to the back surface side in a posture where the pair of projecting pieces 11, 12 is vertically inverted with respect to the flat plate member 1, a turbulence effect is not changed by an insertion direction into the heat-transfer tube 2. Accordingly, the turbulence generator can be inserted into the heat-transfer tube 2 without considering the insertion direction of the turbulence generator. With this configuration, assemble work can be improved.

Moreover, as shown in FIG. 2, since the pairs of projecting pieces 11, 12, and 13, 14 are inclined so that opposed inner ends when viewed from the flow passage direction are extended outward, the increase in pressure loss of the fluid is suppressed. Furthermore, in the pairs of projecting pieces 11, 12, and 13, 14, since the base end portions located in a central portion inside the heat-transfer tube 2 are wider than the forefront portions, the fluid flowing in the central portion inside the heat-transfer tube 2 smoothly flows toward the tube wall 20.

Figure 3:
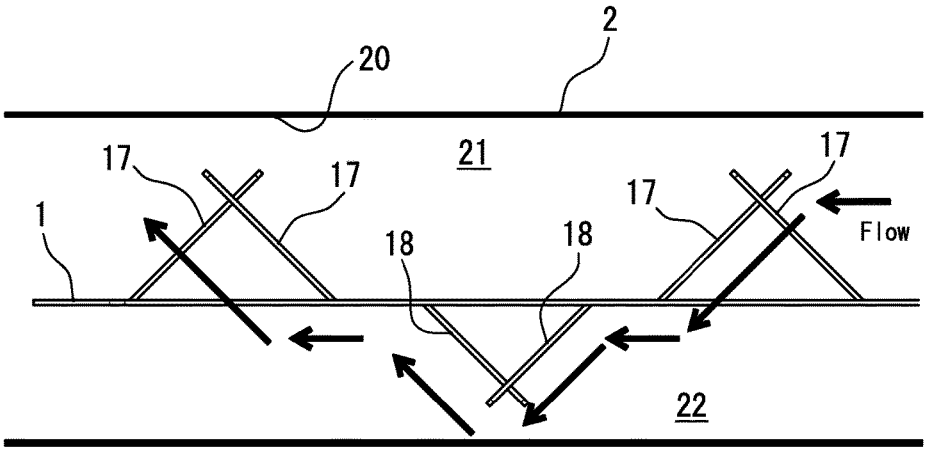
FIG. 3 is a schematic explanatory view showing a turbulence generator according to a second embodiment of the present invention.

FIG. 3 is a schematic explanatory view of a turbulence generator according to a second embodiment of the present invention.

The turbulence generator includes projecting pieces 18 projecting to a back surface side of a flat plate number 1 and having a shorter projecting height than projecting pieces 17 projecting to a front surface side of a flat plate member 1. Therefore, when the turbulence generator is inserted into a heat-transfer tube 2, the flat plate member 1 is set at a predetermined position shifted to a lower region 22 side of the heat-transfer tube 2 with respect to a central portion of a long diameter of the heat-transfer tube 2 having an elliptical cross-sectional shape. This makes the lower region 22 of the heat-transfer tube 2 located under the flat plate member 1 narrower than an upper region 21.

In this embodiment, the heat-transfer tube 2 accommodated in a heat exchanger is heated by a burner from below in the drawing. Therefore, the tube wall 20 in the lower region 22 closer to the burner than the tube wall 20 in the upper region 21 farther from the burner is exposed to a higher-temperature atmosphere.

As described above, in this turbulence generator, since the flat plate member 1 is set at the predetermined position shifted to the lower region 22 side from the central portion of the heat-transfer tube 2, an internal space of the heat-transfer tube 2 is partitioned into a wider space of the upper region 21 and a narrower space of the lower region 22 by the flat plate member 1. As a result, a speed of the fluid flowing in the narrower space of the lower region 22 becomes larger than that of the fluid flowing in the wider space of the upper region 21 . Since the fluid flowing faster in the lower region 22 collides with the shorter projecting pieces 18 projecting to the back surface side of the flat plate member 1, the turbulence is promoted, whereby heat exchange is performed quickly. With this configuration, a rise in temperature of the tube wall 20 in the lower region 22 can be suppressed.

On the other hand, the fluid flowing slowly in the upper region 21 collides with the taller projecting pieces 17 projecting to the front surface side of the flat plate member 1, whereby the turbulence is promoted. However, since heat exchange is also performed slowly because of the slow flow speed, a temperature of the tube wall 20 in the upper region 21 easily rises. Accordingly, although the heat-transfer tube 2 is heated from the lower region 22 side, a difference between the temperature of the tube wall 20 on the upper region 21 side and the temperature of the tube wall on the lower region 22 side becomes smaller, as compared with the case where the internal space of the heat-transfer tube 2 is partitioned substantially equal spaces by the flat plate member 1 as described in the first embodiment. Thus, dew condensation hardly occurs on an outer surface of the tube wall 20 in the upper region 21 of the heat-transfer tube 2 farther from the burner, and an expansion difference in the tube wall 20 decreases. Accordingly, a decrease in durability of the heat-transfer tube 2 can be further prevented.

In this embodiment, since the projecting heights of the projecting pieces 17, 18 projecting to the front and back surface sides of the flat plate member 1 are different, when the turbulence generator is inserted into the heat-transfer tube 2, a vertical direction of the flat plate member 1 is fixed. However, same as the first embodiment, since the pair of projecting pieces projecting from the upstream and downstream-side edges of the one through hole, respectively is inclined so that forefront portions cross each other, the insertion direction into the heat-transfer tube 2 is not fixed. Accordingly, the turbulence generator can be easily inserted into the heat-transfer tube 2.

Figure 4:
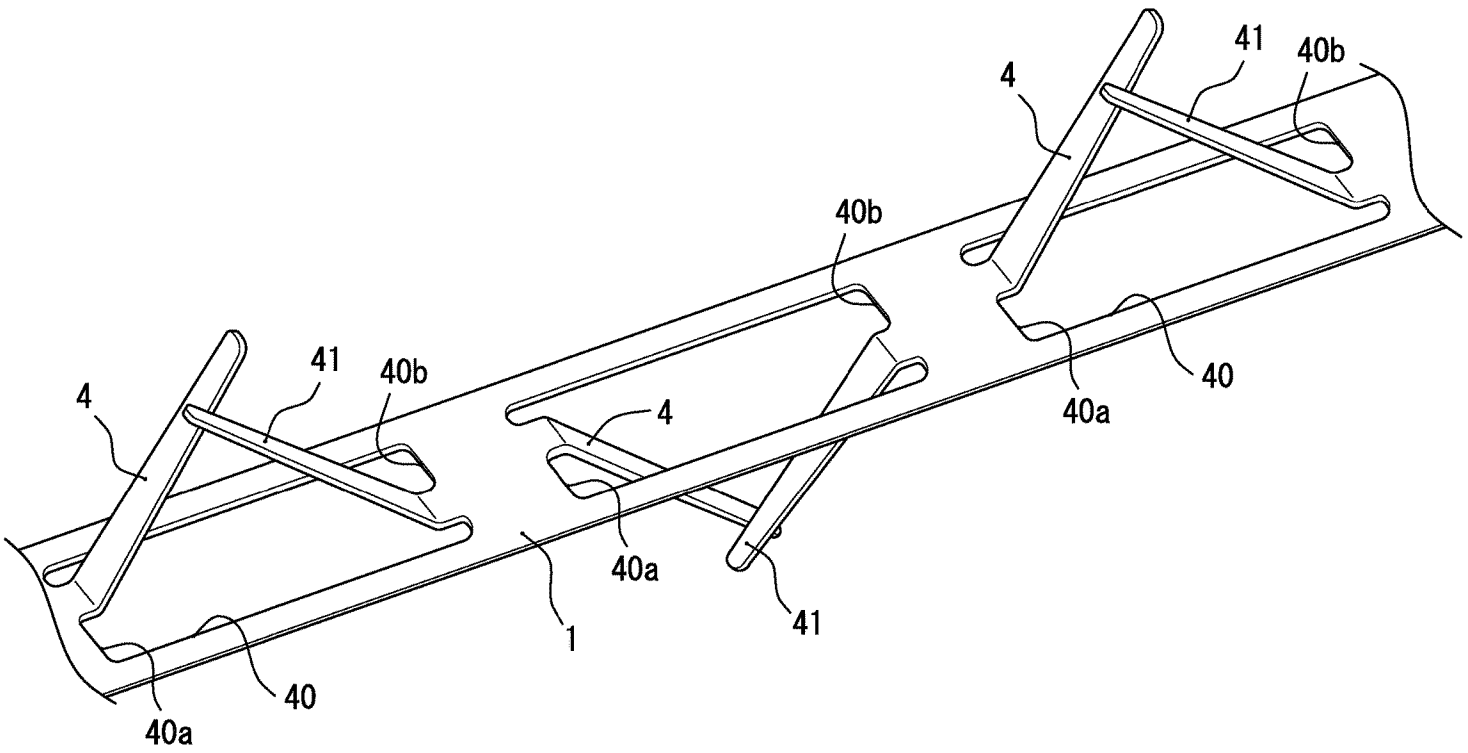
FIG. 4 is a partial schematic enlarged perspective view showing a turbulence generator according to a third embodiment of the present invention.
Figure 5:
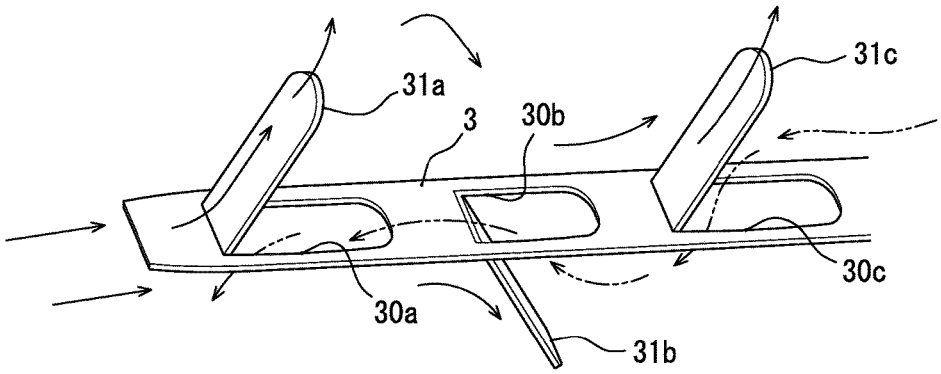
FIG. 5 is a partial schematic enlarged perspective view showing a conventional turbulence generator.

FIG. 4 is a partial schematic enlarged perspective view of a turbulence generator according to a third embodiment. In this turbulence generator, all upstream-side projecting pieces 4 projecting from upstream-side edges 40*a* of through holes 40 are located on a same line on the left when viewed from an upstream side (a left side in FIG. 4) in a flow passage direction, and all downstream-side projecting pieces 41 projecting from downstream-side edges 40*b* are located on a same line on the right when viewed from the upstream side in the flow passage direction.

Since the turbulence generator can be manufactured by slitting a flat plate member 1 so as to be formed the same through holes 40, productivity is improved.

Although each of the turbulence generators according to the embodiments described above has the one pair of projecting pieces projecting respectively from the upstream-side and downstream-side edges of the one through hole, number of the projecting pieces is not limited to one pair. Namely, a turbulence generator may have one or more projecting pieces projecting from the upstream-side and downstream-side edges of the one through hole. Further, although the forefronts of the pair of projecting pieces cross each other in the above embodiments, forefronts may be apart from each other.

As described in detail, the present invention is summarized as follows.

According to one aspect of the present invention, there is provided a turbulence generator configured to generate turbulence in a fluid flowing inside a heat-transfer tube, comprising, a flat plate member extending along a flow passage direction of the fluid flowing inside the heat-transfer tube when inserted into the heat-transfer tube, wherein the flat plate member has a plurality of through holes formed at predetermined intervals in the flow passage direction, and a pair of projecting pieces extending respectively from an upstream-side edge and a downstream-side edge of each of the through holes, wherein the pair of projecting pieces is disposed in parallel inside each of the through holes, and is inclined so that forefront portions thereof approach each other, the pair of projecting pieces extending respectively from the upstream-side edge and the downstream-side edge of any one of the through holes among the plurality of through holes projects to one surface side of the flat plate member, and the pair of projecting pieces extending respectively from the upstream-side edge and the downstream-side edge of other through hole adjacent to the one through hole projects to other surface side of the flat plate member.

According to the turbulence generator described above, since the pairs of projecting pieces alternately project along the flow passage direction on the front and back surface sides of the flat plate member and are inclined so that the forefront portions approach each other, the respective projecting pieces projecting to the front and back surface sides of the flat plate member function similarly with respect to the fluid, regardless of the flow passage direction of the fluid supplied from either end of the heat-transfer tube.

Further, since the pair of projecting pieces is disposed in parallel inside the one through hole, the pair of projecting pieces respectively projects from the positions deviated from each other of the upstream-side edge and the downstream-side edge of the through hole, when viewed from the flow passage direction. Moreover, the pair of projecting pieces projects in the inclined manner so that the forefront portions thereof approach each other. Accordingly, in the upper and lower regions above and below the one through hole, the fluid flowing from the upstream side of the heat-transfer tube collides with both the projecting piece (the upstream-side projecting piece) projecting toward the flow passage direction (a downstream direction) from the upstream-side edge, and the projecting piece (the downstream-side projecting piece) projecting toward a counter passage flow direction (an upstream direction) from the downstream-side edge.

For example, the fluid that collides with the upstream-side projecting piece projecting to the front surface side of the flat plate member provided in the heat-transfer tube flows to the tube wall on a side close to the forefront portion of the upstream-side projecting piece along the front surface of the upstream-side projecting piece. Moreover, after the fluid that collides with the back surface of the downstream-side projecting piece flows to the base end portion of the downstream-side projecting piece, the fluid passes through the through hole and further flows to the back surface side of the flat plate member. The fluid subsequently flows to the tube wall on a side close to the forefront portion of the next upstream-side projecting piece along the back surface of the next upstream-side projecting piece, which projects from the upstream-side edge of the next adjacent through hole to the back surface side of the flat plate member.

Accordingly, according to the above-described turbulence generator, even if the flow passage direction of the fluid is reversed (that is, even if the insertion direction of the turbulence generator becomes opposite), the pair of projecting pieces exerts the same function with respect to the fluid.

Preferably, in the turbulence generator described above, the projecting piece extending from the downstream-side edge of the one through hole and the projecting piece extending from the upstream-side edge of the other through hole adjacent on a downstream side of the one through hole are located on a same line in the flow passage direction.

According to the above-described turbulence generator, the fluid flows along the projecting pieces located on the same line on the left or on the right in the flow passage direction through a connecting portion between the two adjacent through holes. Accordingly, the fluid can be smoothly guided to the tube wall.

Preferably, in the turbulence generator described above, a projecting height of the pair of projecting pieces projecting to the one surface side of the flat plate member is larger than a projecting height of the pair of projecting pieces projecting to the other surface side of the flat plate member, and an internal space of the heat-transfer tube is partitioned into a wider region on the one surface side and a narrower region on the other side surface by the flat plate member.

According to the above-described turbulence generator, since the turbulence generator which has the projecting pieces with different lengths projecting to the one and other surface sides of the flat plate member respectively, is inserted into the heat-transfer tube, the flat plate member is set in a shifted position with respect to a central portion of the heat-transfer tube. As a result, in the heat-transfer tube, one region on the one surface side to which the taller projecting pieces project is wider than other region on the other surface side to which the shorter projecting pieces project.

On the other hand, the heat-transfer tube accommodated in a heat exchanger is generally heated by a burner from one direction (such as from below a heat exchanger) . Therefore, a temperature of the tube wall closer to the burner is likely to be higher than a temperature of the tube wall farther from the burner. As a result, an expansion difference between the tube wall closer to the burner and the tube wall farther from the burner is likely to be larger.

However, according to the turbulence generator described above, the internal space of the heat-transfer tube is partitioned into the wider region on the one surface side and the narrower region on the other side surface by the flat plate member. Therefore, a speed of the fluid flowing in the wider region of the heat-transfer tube becomes smaller than that of the fluid flowing in the narrower region.

A heat exchange rate of the fluid flowing slower in the wider region is lower than that of the fluid flowing faster in the narrower region. Therefore, if the turbulence generator is inserted into the heat-transfer tube in such a manner that the wider region is located farther from the burner, the temperature of the tube wall in the wider region on the one surface side is higher, as compared with that of the tube wall on the one surface side farther from the burner when the internal space of the heat-transfer tube is partitioned equally by the flat plate member. As a result, a difference between the temperature of the tube wall closer to the burner and the temperature of the tube wall farther from the burner becomes smaller. Accordingly, since it makes possible to reduce the expansion difference of the heat-transfer tube and prevent dew condensation from occurring on an outer surface of the heat-transfer tube farther from the burner, a decrease in durability of the heat-transfer tube can be further prevented.

Preferably, in the turbulence generator described above, the pair of projecting pieces is inclined so that the forefront portions thereof cross each other.

According to the above-described turbulence generator, since the pair of projecting pieces is inclined so that the forefront portions thereof cross each other, the fluid collides a crossover portion of the forefronts. Accordingly, the turbulence on the tube wall side can be further promoted.

As described above in detail, according to the turbulence generator of the present invention, since the pairs of projecting pieces alternately project along the flow passage direction on the front and back surface sides of the flat plate member and are inclined so that the forefront portions approach each other, it makes possible to increase opportunities of generating the turbulence regardless of the flow passage direction inside the heat-transfer tube. Thus, the fluid smoothly flows to a vicinity of the tube wall inside the heat-transfer tube, whereby the turbulence can be promoted. Accordingly, the heat exchange rate of the heat exchanger can be improved.

Further, even if the turbulence generator is inserted into the heat-transfer tube from the opposite direction, the turbulence effect is not changed, and the insertion direction of the turbulence generator is not fixed. Thus, the turbulence generator can be inserted into the heat-transfer tube without considering consistency of the flow passage direction of the fluid flowing inside the heat-transfer tube with inclination directions of the projecting pieces of the turbulence generator. Accordingly, assemble work can be improved.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A turbulence generator configured to generate turbulence in a fluid flowing inside a heat-transfer tube, comprising, a flat plate member extending along a flow passage direction of the fluid flowing inside the heat-transfer tube when inserted into the heat-transfer tube, wherein the flat plate member has a plurality of through holes formed at predetermined intervals in the flow passage direction, and a pair of projecting pieces comprising an upstream-side projecting piece that extends from an upstream-side edge of each of the through holes and a downstream-side projecting piece that extends from a downstream-side edge of each of the through holes, each of the upstream-side and downstream-side projecting pieces having free forefront portions such that each projecting piece is only directly attached to one the upstream-side edge and the down-stream side edge, wherein the pair of projecting pieces is disposed in parallel inside each of the through holes, and is inclined so that the pair of projecting pieces thereof approach each other, the pair of projecting pieces extending respectively from the upstream-side edge and the downstream-side edge, of any one of the through holes among the plurality of through holes, in a same direction relative to a plane formed by the flat plate member, and the pair of projecting pieces extending respectively from the upstream-side edge and the downstream-side edge of other through hole adjacent to the one through hole projects to other surface side of the flat plate member.

2. The turbulence generator according to claim 1, wherein the projecting piece extending from the downstream-side edge of the one through hole and the projecting piece extending from the upstream-side edge of the other through hole adjacent on a downstream side of the one through hole are located on a same line in the flow passage direction.

3. The turbulence generator according to claim 1, wherein a projecting height of the pair of projecting pieces projecting to one surface side of the flat plate member is larger than a projecting height of the pair of projecting pieces projecting to the other surface side of the flat plate member, and an internal space of the heat-transfer tube is partitioned into a wider region on the one surface side and a narrower region on the other side surface by the flat plate member.

4. The turbulence generator according to claim 1, wherein the pair of projecting pieces is inclined so that the forefront portions thereof cross each other.

* * * * *